US006575302B2

(12) United States Patent
Robley, Jr.

(10) Patent No.: US 6,575,302 B2
(45) Date of Patent: Jun. 10, 2003

(54) DISPLAY TYPE PACKAGING SYSTEM

(76) Inventor: Spencer Hart Robley, Jr., 13603 Marina Pointe Dr., No. B-422, Marina del Rey, CA (US) 90292

( * ) Notice: Subject to any disclaimer, the term of this patent is extended or adjusted under 35 U.S.C. 154(b) by 0 days.

(21) Appl. No.: 09/778,304

(22) Filed: Feb. 6, 2001

(65) Prior Publication Data

US 2002/0104777 A1 Aug. 8, 2002

(51) Int. Cl.[7] ..... B65D 85/00
(52) U.S. Cl. ..... 206/776; 206/781; 206/480
(58) Field of Search ..... 206/477–481, 206/756–765, 775–783; 446/73, 74

(56) References Cited

U.S. PATENT DOCUMENTS

| | | | | | |
|---|---|---|---|---|---|
| 491,136 | A | * | 2/1893 | Rosenblatt et al. | 206/480 |
| 698,272 | A | | 4/1902 | Glover | |
| 713,888 | A | | 11/1902 | Kellner | |
| 826,217 | A | | 7/1906 | Atkinson | |
| 1,492,113 | A | * | 4/1924 | Welsh | 206/478 |
| 1,643,421 | A | | 9/1927 | Rowan | |
| 1,712,686 | A | * | 5/1929 | Bornmann | 206/480 |
| 2,340,390 | A | | 2/1944 | Kitto | 206/16 |
| 2,387,639 | A | | 10/1945 | Bouchelle | 206/80 |
| 2,582,476 | A | * | 1/1952 | Buttery | 206/777 |
| 2,723,747 | A | * | 11/1955 | Oxenfeld | 206/777 |
| 2,724,208 | A | * | 11/1955 | Nelson | 206/776 |
| 2,903,139 | A | | 9/1959 | Penman | 211/60 |
| 2,941,664 | A | | 6/1960 | Palmer | |
| 3,154,281 | A | | 10/1964 | Frank | 248/201 |
| 3,324,997 | A | * | 6/1967 | Bonanno | 206/765 |
| 3,406,816 | A | | 10/1968 | Green et al. | 206/45.34 |
| 3,473,247 | A | | 10/1969 | La Favor et al. | 40/126 |
| 3,512,741 | A | | 5/1970 | Goldstein | 248/206 |
| 3,811,565 | A | * | 5/1974 | Tancredi | 206/478 |
| 3,822,783 | A | | 7/1974 | Mortensen | 206/223 |
| 3,827,152 | A | | 8/1974 | Dailey | 33/174 B |
| 3,927,765 | A | | 12/1975 | Beal | 206/481 |
| 4,228,896 | A | * | 10/1980 | Wu | 206/480 |
| 4,586,615 | A | | 5/1986 | Quitmann | 211/70.6 |
| 4,606,735 | A | | 8/1986 | Wilder et al. | 604/180 |
| 4,714,160 | A | * | 12/1987 | Bennett | 206/776 |
| 4,887,709 | A | | 12/1989 | Shimamine | 206/45.14 |
| 4,943,183 | A | | 7/1990 | Nakano | 403/406.1 |
| 5,080,240 | A | | 1/1992 | Williams | 211/70.6 |
| D327,801 | S | | 7/1992 | Lee | D6/553 |
| 5,398,820 | A | | 3/1995 | Kiss | 211/13 |
| 5,896,991 | A | | 4/1999 | Hippely et al. | 206/461 |
| 5,980,352 | A | | 11/1999 | Rigberg | 446/73 |
| 6,206,750 | B1 | * | 3/2001 | Barad et al. | 446/268 |

OTHER PUBLICATIONS

"Clear Stays" figure mounting product: created by Spencer H. Robley, Jr.; disclosed and assigned to Mattel, Inc. prior to Oct. 23, 1998 (*See*, Robley affidavit and the seven photographs Attachment A appended thereto).

"Snap–In Matrix" figure mounting concept: created by Spencer H. Robley, Jr.; disclosed to Mattel, Inc. prior to Feb. 6, 2000 (*See*, Robley affidavit and Attachment B appended thereto).

* cited by examiner

*Primary Examiner*—Jim Foster
(74) *Attorney, Agent, or Firm*—Holland & Knight LLP

(57) ABSTRACT

A package which can display the contents includes a carton having at least a portion of a front wall which is transparent. Inside the cavity of the carton is an insert which has a plurality of projections having clamps which are designed to engage portions of the displayed contents, the projections extending away from the back of the carton to lend a three-dimensional effect to the display. The insert may be of a transparent plastic material so that the inside surfaces of the carton may be decorated in a fashion independent of the shape of the product displayed or the manner in which it is positioned. The insert also has a number of extension arms which register the insert securely inside the cavity, and which may also act as supports for the insert to act as a display stand when not inside the carton.

28 Claims, 4 Drawing Sheets

DISPLAY TYPE PACKAGING SYSTEM

BACKGROUND OF THE INVENTION

1. Field of the Invention

The present invention relates to packaging systems for the containment of small articles for sale, and finds its particular utilization in packages which are designed to display the contents and, in particular, to display the contents in a pleasing and artistic way. Many types of products are presently sold in display packages. Typical among them are toys, dolls, sporting goods items, hardware items and other general merchandise where having a display window communicates more to the potential purchaser about the product and its use than two-dimensional renderings printed on the outside of the carton. The present invention is disclosed herein with respect to packaging for dolls although features of the invention to be described herein lend themselves to use with numerous other products.

2. Background

Dolls, particularly those intended for collectors, have long been sold in display type packages so that the customer can see the actual doll that is in the package and how it is attired. Many of these products, including the famous Barbie Doll®, often comprise collections of unique, one of a kind objects or dolls such that seeing the actual doll itself without opening the box contributes greatly to sales. Because such dolls in their packages pass through many hands from the location of manufacture to the point of sale, it is necessary to anchor the doll securely in the package so that it is not damaged during shipment or, for that matter, while being displayed at the retail level. Thus, it has been necessary to provide a means for securely attaching the doll, or other object, firmly to the backing of the package. Typically, this is being done today by securing the object in the package with a plurality of twist-tie wires extending around portions of the object and through apertures in the back of the package were securement is obtained by twisting the ends of the wires together, firmly grasping the object inside. In some instances, rather than or in addition to having apertures in the back of the package, the doll or other object is secured to a separate insert card, the dimensions of which conform in general to the internal dimensions of the package itself and, after securement, the doll and insert card are placed inside the package.

While these twist-tie securement schemes have successfully achieved the principal objective of securely mounting an object in a package to obviate damage or injury to the object during shipping and handling, these schemes suffer from a number of shortcomings as well. Each twist-tie has a finite cost, albeit small, yet when the object is finally removed from the package, the twist-ties are removed and become loose objects. On those products, which are sold to small children, for example, these small objects become a safety hazard such that many toy products require a warning label on the package that there are objects in the package which if swallowed, for example, could present a threat of injury or harm to small children. These tie-down schemes are also unattractive. After a doll is removed from such a package, the package is essentially of no further use other than to merely house the original contents, rather than to display it in its original manner, unless one reinstalls the twist-ties. The twist-ties which extend through the insert card or through the back of the package present a condition where they can become dislodged or unfastened somewhere in the shipping or handling process or even on a shelf where they are stored or displayed for sale. Also, and of particular interest with regard to collectible items, if the installer overly tightens the twist-tie during the securement process, it can blemish or scar the object and can thereby significantly diminish its collectible value.

An additional shortcoming of the packaging schemes used to date is in the area of decoration/ornamentation. Display type packages (i.e., those which display the contents) frequently employ background decoration complimentary to the style of the object displayed to thereby present a pleasing countenance for the object being sold. A designer's freedom to provide ornamentation is somewhat limited as compared to the present invention in that the present securement system described herein requires that some pre-thought be given to where (on either the slideable insert backing or the backing of the box itself to locate the apertures to accommodate the twist-ties. In mass produced packaging systems, the variety of locations of the apertures which accommodate the twist-ties must be limited. If a different pose for the object displayed is desired, the apertures must be relocated. Thus, for a particular doll, for example, to display in a particular pose, the locations of the apertures for the twist-ties will be pre-selected according to the pose chosen. The artist doing the ornamentation of the display box can then decide what type of background display goes either on the insert or on the inside of the box. Having made this decision, multiple copies of that box configuration will be produced and, while the design and ornamentation could be changed from product to product, the obvious changes necessary for each type of pose for a given doll limits the extent of the artist's freedom to provide varying ornamentation. Finally, because of this configuration of packaging, the doll itself must be secured in contact with the back of the box or the slideable insert and a planar surface or surfaces provide a definite limitation in package configuration, decoration and overall aesthetic appeal.

SUMMARY OF THE INVENTION

Briefly, the present invention comprises a packaging system in which the doll or other object is held firmly in place inside a carton by a selected set of posts which carry snap clamps, preferably of a "C"-shaped configuration, which are in turn affixed via the posts to a backing plate. The backing plate as well as the post and clamps are preferably constructed of a transparent material and is slideably inserted into the carton. The corners of the backing plate are provided with extensions which serve the purpose of firmly registering the backing plate inside the box, irrespective of the box's configuration. Thus, non-planar backing plates can be utilized as well as flat plates. In addition, the utilization of a transparent material for the backing plate and anchoring members allows the packaging designer a greater freedom of choice in display ornamentation in that the designer is not restricted by the shape of the containment system. Thus, the same shape of backing plate and securement means can be used for many different dolls having many different background decoration modes. Also, eliminating the twist-ties eliminates a possible children's health or choking hazard. In addition, the snap-in packaging system provides a way in which the doll, or the like, can be replaced in the box for display and/or storage; or the backing plate, once removed from the box, can be used as a stand-alone display stand for collectible items.

Accordingly, it is an object of the present invention to provide an improved display packaging system which has a secure means of packaging a doll, or the like, so that it is not loose in the package, thereby eliminating potential harm to the object during shipping and handling, yet allowing improved aesthetics in the display.

Moreover, it is an object of this invention to provide a reusable securement system for dolls and other collectibles such that they can be repositioned in the package or displayed outside the packaging utilizing the same securement system in which the dolls were originally packaged.

It is also an object of the present invention to provide the backing system with sufficient lateral support means to adequately and firmly hold the attached doll and the backing plate inside the package so that it does not move about while shipping and handling and which strengthens the carton. These positioning arms or extensions of the backing plate likewise form a means of providing a stand so that the doll, or the like, can be reinserted in the securement means and/or displayed for view.

These and other objects and advantages of the present invention will become readily apparent from the detailed description taken in conjunction with the accompanying drawings.

DETAILED DESCRIPTION OF THE PRIOR ART

Figure 1:
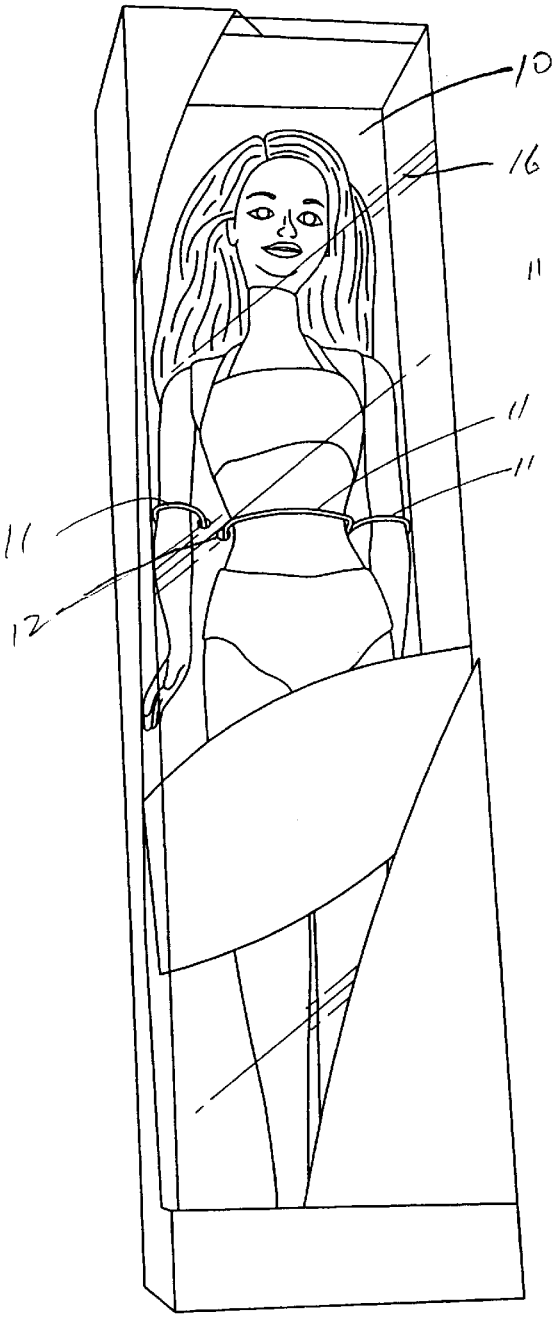
FIG. 1 PRIOR ART
FIGS. 1 and 2 represents similar forms of prior art methods of display packaging.
Figure 2:
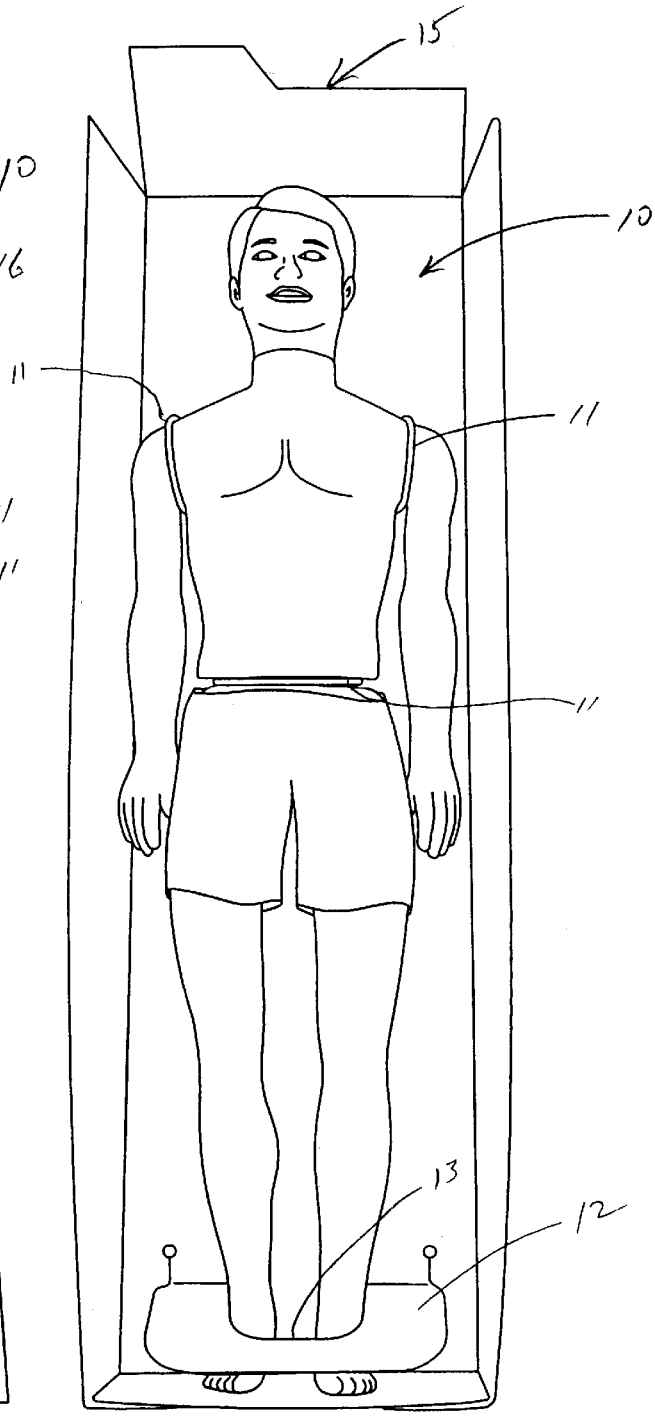
FIG. 2 PRIOR ART

As previously mentioned, FIG. 1 and FIG. 2 both display different styles of securement used in the past for dolls in display packages. These embodiments constitute what has frequently been referred to as a secure capture mechanism. The dolls are securely affixed against the back of the package whether it be a separate slideable insert as shown in FIG. 2 or the back of the package itself as seen in FIG. 1. These packages are conventionally made of chipboard, pressed cellulose, fiberboard or cardboard. Pieces of wire commonly known as twist-ties 11 consist of wire which is sometimes surrounded by plastic, rubber, cloth or the like. These wires are placed around, for example, the arms and waist of the doll as in FIG. 1 and through apertures 12 behind of the back section 10 where they are, on the other side of back 10, twisted together to firmly affix the doll against the backing 10. In the case of the doll shown in FIG. 2, the wire ties 11 may be positioned in other locations depending upon the costume of the doll or the configuration in which the doll is posed. FIG. 2 shows an alternative form of capturing the lower portion of the doll which consists of a cutout from the backing 10 to form a flange 12 having an opening 13 into which the dolls feet may be inserted to secure the doll against the backing 10. The same type of flange 12 may be employed in the FIG. 1 prior art configuration or, in other instances, similar wire ties are used to secure the feet.

FIG. 1 shows a doll secured in the manner described where the doll is actually captured firmly against the back 10 which forms the back of the package itself. On the other hand, FIG. 2 shows a slideable insert 15 having a back plate 10 as a portion thereof. In this latter manner, the doll is first secured to the backing, then the sides are folded and the combination is slid into a carton similar to FIG. 1 having a transparent front area 16 also similar to that shown in FIG. 1. It will be noted that the prior art securement methodology (that is, the secure capture mode) uses as one of its primary features the securement of the packaged object securely against the back portion 10; i.e., maintained in an immobile state by a combination of twist-ties or elastics or the like adhering the displayed object securely against the back 10 of the carton. As will be more fully set forth hereinafter, one of the advantages and features of the present invention is to eliminate that securement against the back 10 as an element of freedom of the present invention. The elimination of twist-ties altogether is another object.

DETAILED DESCRIPTION OF THE PREFERRED EMBODIMENT

Figure 3:
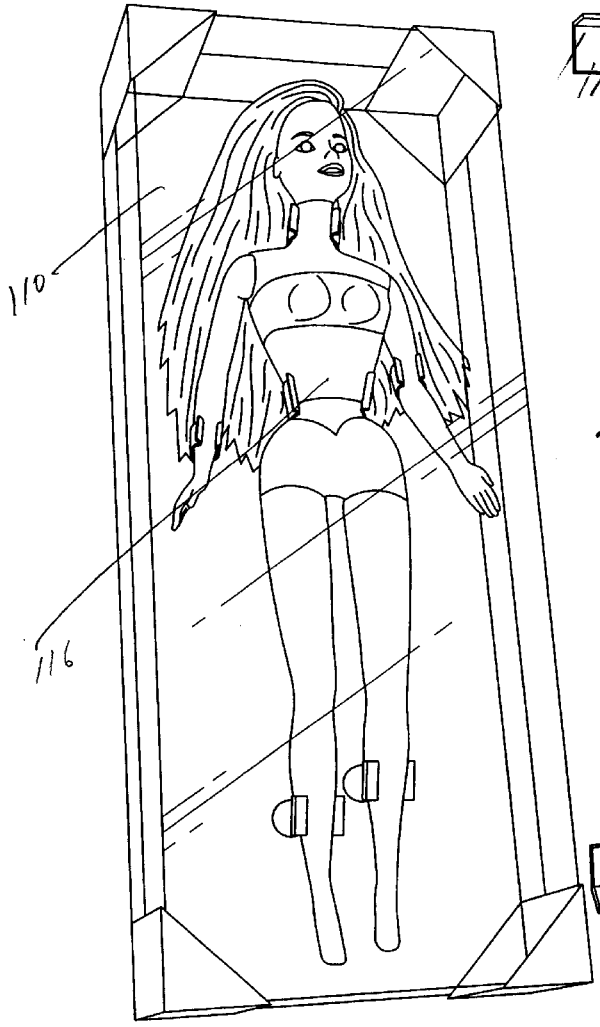
FIG. 3 is a perspective view of a package employing the post and C-clamps means of securement which form one of the embodiments of the present invention.
Figures 4, 5:
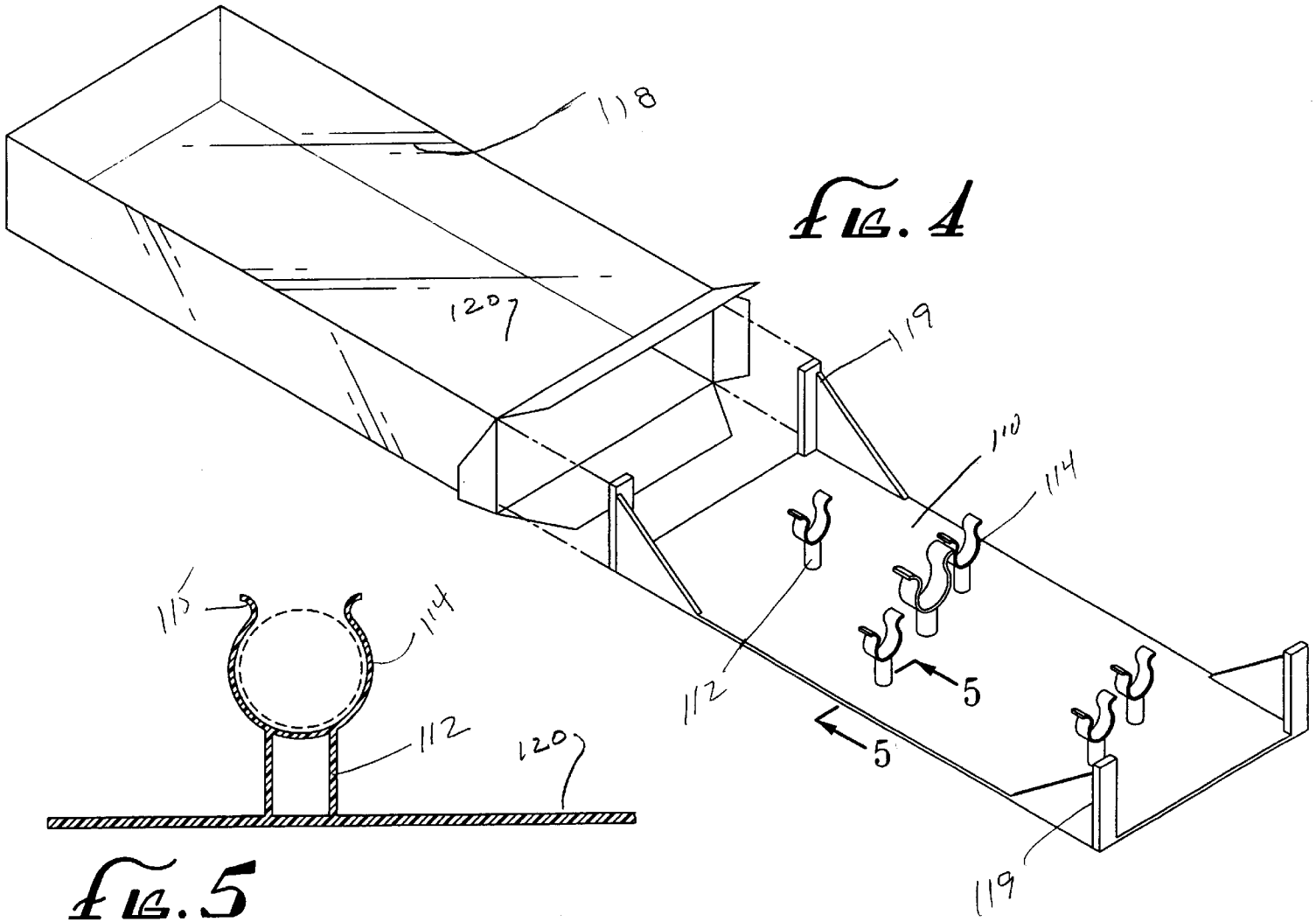
FIG. 4 is an exploded view of a package employing the features of the present invention.
FIG. 5 is a detail view take along line 5—5 of FIG. 4 showing in diagram the form of the post and C-clamp combinations.

Referring now in detail to the drawings and, specifically, FIGS. 3, 4 and 5, the packaging 100 of the present invention comprises a back plate 110 which is comprised of a transparent material and, rather than having apertures 12 through which twist-ties 11 of the prior art extend to secure the displayed product (a doll) in the package, provides instead a plurality of securement means comprising posts 112 forming a part of the back plate 110 upon which are mounted clamping devices 114, which can be shaped like a "C" or "U" or other suitable shape depending upon the packaged item. In the embodiment shown in FIG. 3, these posts 112 and clamps 114 are a composite or unitary structure. They are chosen to be located as a part of the back plate 110 in positions to securely affix the displayed device (a doll) in a pose chosen by the designer. By providing the C-clamps 114 in the configuration shown in FIG. 5, with a reverse curvature portion 115, it is possible to provide a snap-in securement which securely locks the limbs of a doll (for example) in any desired position without intruding on the view or the product displayed. For added security, an elastic band or the like could be attached interlocking with the reverse-curved portion to entirely surround a portion of the packaged product.

It is well-known in the packaging field and, in particular with respect to the packaging of dolls, to employ 3-D lithography or 3-D "cad cam" lithography to produce a package. Utilizing a suitable software program such as the one known as "Ashlar Score 3-D," a designer can take the object to be displayed (e.g., the doll 116 such as shown in FIG. 3), decide what configuration or pose for the displayed object is most desirable in the designer's point of view and then utilizing the 3-D lithography program design the package by locating the posts or projections 112 with their attendant clamps 114 in chosen positions for the pose or display of the model. Thus, for an insertable system consisting of a back plate 110, projections 112 and clamps 114, a package designer decides the pose chosen and then the 3-D software generates the back plate like that shown in FIG. 4, causing the manufacturing system to produce the desired result in multiple copies.

One of the advantages of this improved securement concept is that it permits the placing of the displayed object away from the back plate 110 so that the doll, for example, is no longer displayed against the back of the package but rather has a three-dimensional aspect. An advantage to this securement methodology is that the designer of the package is now permitted a greater degree of freedom to design art work inside the package as will be more fully set forth hereinafter. Because the doll, for example, is no longer stuck to the back of the package, greater freedom of aesthetics in the entirety of the package is available for the designer.

Now that a choice of locations for the attachment means 112, 114 is placed in the hands of the designer, the entire package of the back plate 110 and the securement means 112, 114 can be chosen to best display an artistic pose for the doll. By forming the back plate 110 and securement means 112 and 114 of a unitary structure, of transparent material, the designer is given additional freedom to design the interior and exterior surfaces of the package not restricted by the form, shape or location of the back plate and the securement means. In other words, the combination shown in FIG. 4 allows a designer to configure a doll in a desired pose without the constraint of pre-planning the art work that goes on the inside surfaces of the carton.

For example, in FIG. 4, there is a carton having a transparent front cover 118 and having the remainder of the sides either transparent or opaque as desired. By using the securement means shown in FIGS. 3 and 4, the artistic input to the box ornamentation is no longer dependent upon what is to be printed upon the back plate 110 as the interior surfaces of the cavity of each package can be individually decorated differently. Thus, for a desired run of models of a particular doll, the poses can be selected and the locations of the securement means 112, 114 can be decided upon, yet the decoration of the box for display purposes and, in particular the art work on the insides and back 120 of the carton, is left completely free for ornamentation at the selection of the designer.

Figure 6:
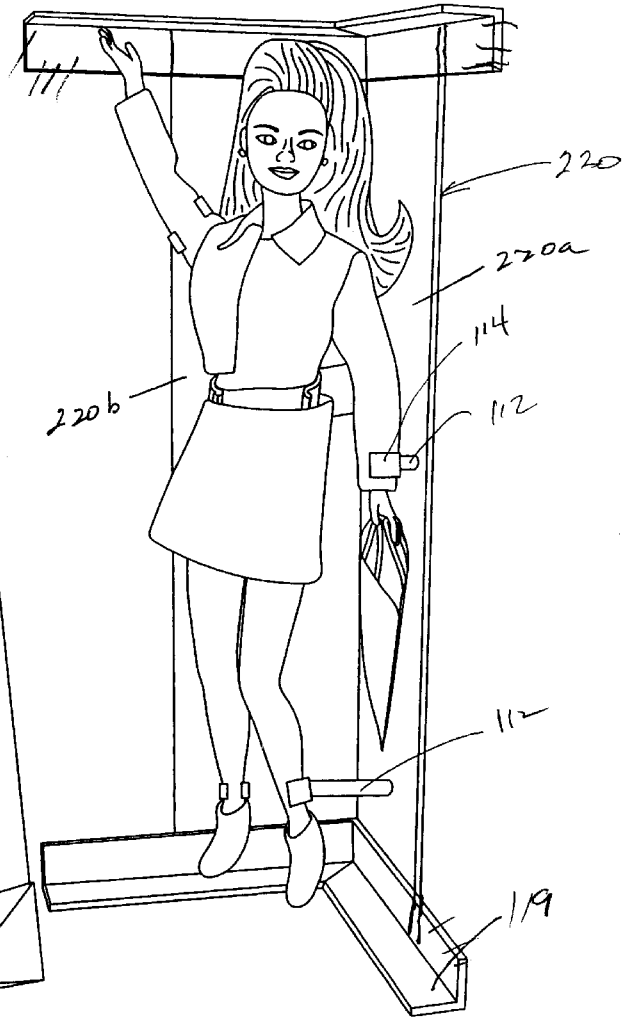
FIG. 6 is an embodiment of the present invention in which the back plate has more than one planar surface, in this case two planes at an angle.

Turning now to FIG. 6, a particular advantage resulting from the present invention is that contrary to that disclosed in the prior art, the backing sheet 110 no longer needs to be a two-dimensional or flat, planar structure. FIG. 6 discloses a system employing the details of the present invention in which the back plate 220 is now of two- or three-dimensions. 20 In FIG. 6, back plate 220 consists of two portions 220*a* and 220*b* at right angles forming a unitary structure, yet the features of the present invention which include the posts 112 and clamps 114 can be positioned on either of the back plate portions 220*a* or 220*b*. Again, a greater degree of freedom for artistic expression of the package designer is provided.

Figure 9:
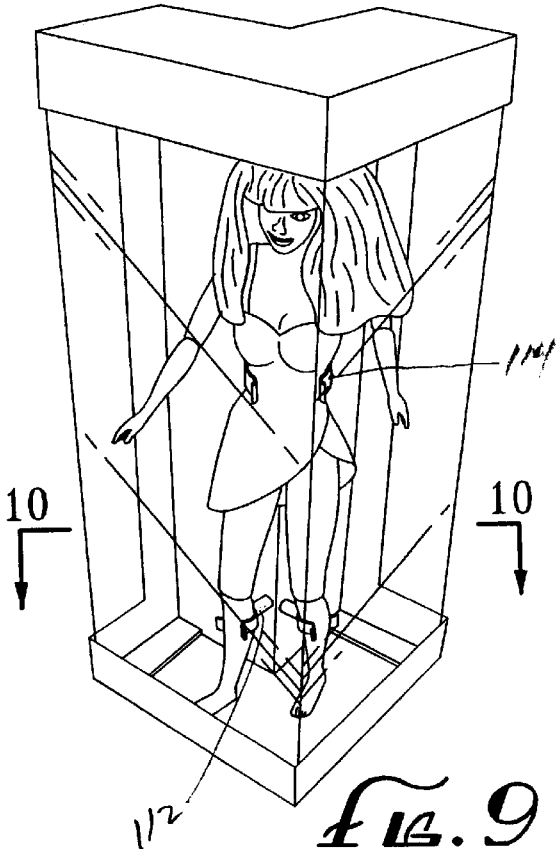
FIG. 9 is another embodiment where the back plate has an angular shape.
Figure 8:
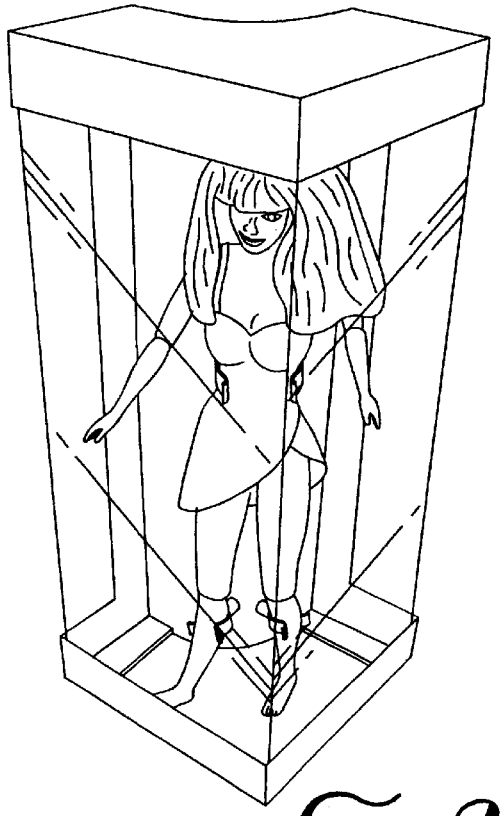
FIG. 8 is another embodiment where the back plate is non-planar.

FIGS. 8 and 9 show additional configurations made possible by the present invention in that back plate 220 is no longer required to be a two-dimensional flat surface. Securement of the displayed product is still firmly maintained by the securement means 112, 114, yet the restriction to a planar back surface is no longer required.

As a further feature of the invention, it will be noted in FIG. 4 that the back plate 110 is provided with extensions 119 at each of the corners. One of the purposes of the extensions 119 is to firmly register the backing plate 110 inside the carton. Because the twist-ties are eliminated, the back plate is slideable inside in the carton; but it is desirable that the back plate 110 not be permitted to move about the interior cavity of the package. Thus, the extensions 119 at corners of the back plate 110 are designed to register with the interior corners of the carton, thereby securing the plate and the product inside the carton.

Figure 7:
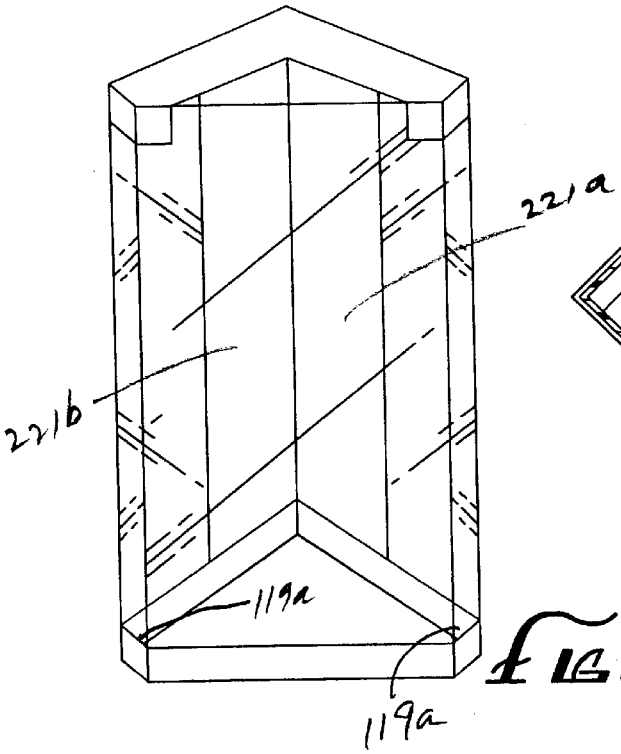
FIG. 7 is a form of display carton adapted to contain the back plate configuration of FIG. 6.

Referring for greater example to FIGS. 6 and 7, the employment of the non-planar backing plate 220 with the extensions 119 can be placed in a carton configured as shown in FIG. 7 whereby extensions 119 register with the interior similarly shaped corners 119*a* of the carton thereby firmly holding the backing plate and the displayed product firmly within the carton. By providing the backing plate 220 of a transparent material, the interior walls of the package shown in FIG. 7 can then be decorated in a variety of different ways at the designer's choice so that each doll or series of dolls, for example, can be artistically displayed in unique ways.

Additional advantages are obtained from the extensions 119 in that they rigidify the overall carton for the product. As mentioned previously, products of this type are transmitted through freight, and shipping and handling, in a number of various ways, and the product can be subjected to severe forces during such transit. By providing rigidifying extensions 119 at the corners of the package, crushing of the package can be reduced.

In the genre of collectible products, any deterioration or defect in the package or indeed in the product itself can result in a decreased or significantly decreased value of not only the contents but the overall salability of the commodity as a whole. The provision of the extensions 119 as thus provides a particular enhancement in retail value of the overall product.

An additional benefit gained from the extensions 119 is their employment as a supporting structure which permits the displayed product to be replaced in its original position in the package in which it originally came, such that the integrity of the displayed object is or can be maintained in the same aesthetic fashion. Thus, the product can be reinserted in its original box and stored safe from outside elements which might maim or mar its appearance.

In addition, the extensions 119 provide legs or supports which can permit the object originally displayed in a box, to be displayed without the box for the purposes which collectors find useful in displaying their treasures. By providing the securement means 112, 114 in their original positions, a collectible doll, for example, can now be placed in its original pose for display purposes as collectors desire.

As aforementioned, one of the additional features of the present invention is that the securement means 112, 114 space the product away from the backing of the box thereby providing a three-dimensional or a greater three-dimensional display aspect than that which was previously presented by the prior art which affixed the displayed object firmly against the backing. Thus, the inside of the box in which the product 116 is inserted can be decorated in a number of ways independent of the position of the securement means 112, 114 independently of the manner in which the doll is posed. Thus, the designer has a greater degree of freedom in designing the package; in that, having selected a pose for a doll, the designer is not restricted by the configuration of the backing plate 110 in designing the interior and exterior of the package. For a particular configuration or pose for the doll, the package can present a plurality of decorations to present a doll in a more aesthetic and therefore marketable means for each individual doll than was previously permitted by the secure containment system of the prior art.

As an alternative embodiment in FIGS. 4 and 5, it will be seen that the clamps 114 are provided having reverse curvature portions 115 at the extremities. These reverse curvature portions provide for additional temporary securement of a doll or other heavy object inside a package. In this embodiment, the reverse curvature portions 115 permit the utilization of an elastic or wire securement element to engage the reverse curvature portions 115 in a way which would in a more definite way securely affix the displayed object within the clamps 114. These elements could be discarded after opening the box as they would not ordinarily be anticipated as necessary for the subsequent storing and/or display of the packaged product. They would, however, provide another degree of assurance that during shipment and handling of the product from its point of manufacture to its point of retail sale that the displayed object would not be displaced from its securement within the box.

FIGS. 8 and 9 show alternative configurations for the overall shape of the package in which the backing plate 330 can either be curved, as shown in FIG. 8, or having multiple planes, as shown in FIG. 9. Again, each back plate is provided with extensions 119 to register the combination in the interior cavity of the package. Thus, FIGS. 8 and 9 provide yet again further choices for the designer to artistically display products such as dolls, and the transparency of the backing plate provides the manufacturer with an economical means of securing the doll inside the package without limiting the artistic decoration of the interior of the package so that each package can be decorated differently for each doll.

Figure 10:
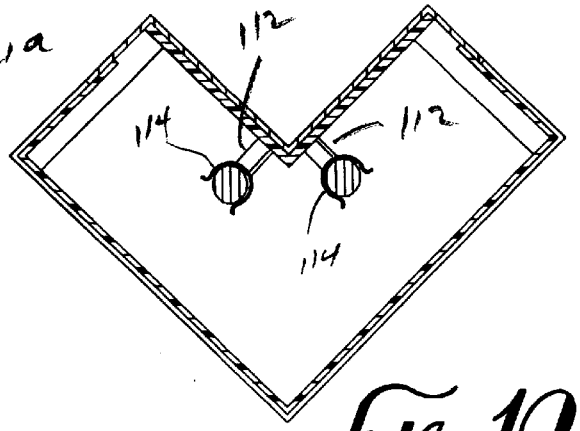
FIG. 10 is a detail view taken along line 10—10 of FIG. 9.

FIG. 10 is a sectional view taken along line 10—10 of FIG. 9 showing the projections 112 and clamps 114 applied as desired to the legs of the doll to secure that portion of the doll in place. Posts and clamps 112, 114 may be supplied inside each of the packages of FIGS. 8 and 9 to secure the doll at the waist and/or one or both of the arms and legs as desired for the particular product being packaged.

As illustrated by one or more of the preferred embodiments described above, a package has been disclosed which can display its contents. The package includes a carton having at least a portion of a front wall which is transparent. Inside the cavity of the carton is an insert which has a plurality of projections having clamps which are designed to engage portions of the displayed contents, the projections extending away from the back of the carton to lend a three-dimensional effect to the display. The insert may be of a transparent plastic material so that the inside surfaces of the carton may be decorated in a fashion independent of the shape of the product displayed or the manner in which it is positioned. The insert also has a number of extension arms which register the insert securely inside the cavity, and which may also act as supports for the insert to act as a display stand when not inside the carton. contemplates that the projection arms 112 may be either integral with the backing plate or otherwise attached to the backing plate. For a variety of manufacturing reasons, the securement clamps 114 could be integrally formed with the projections 112 or, in instances where different shapes of clamps may be necessary to accommodate different portions of the product contained in the package, ease of manufacture may dictate that the clamps be separately manufactured and later attached to an end of the projection or post 112. Likewise, while the planar backing plate 110 shown in FIG. 4 is readily manufactured as a single piece, the multi-planar back plates of, for example, FIGS. 8 and 9 could be manufactured in pieces which could interlock together or be adhesively joined in a number of ways.

While a preferred embodiment and several alternative configurations of the present invention have been shown and described, it will be apparent to persons skilled in the art that additional variations and changes from that disclosed and described herein are possible such that the utilization of the present invention provides new and improved ways of displaying products for retail sale in a manner which is aesthetically pleasing with a great degree of freedom of artistic expression possible to further enhance the sale of such items. Insofar as these variations and changes are within the purview of the appended claims, they are to be considered as part of the present invention.

What is claimed is:

1. A package adapted to display contents thereof, said package comprising:

a carton having a rear wall and a front wall to define an interior cavity, said front wall having a transparent portion forming a window, a slideable insert adapted to fit into said cavity and register with the inside thereof, said insert having a back plate, said back plate having a plurality of individual rigid posts affixed thereon, said posts having securement clamps formed thereon adapted to engage the contents of the package, wherein locations and number of said posts being chosen according to the manner in which the contents are to be displayed.

2. The package as set forth in claim 1, wherein said insert having said back plate, said posts and said clamps are formed as an integral unit.

3. The package as set forth in claim 1, wherein the back plate is non-planar.

4. The package as set forth in claim 1, wherein the back plate is formed having more than one plane.

5. The package as set forth in claim 1, wherein the back plate is formed having a curvilinear portion.

6. The package as set forth in claim 1, wherein the securement clamps are formed having a C-shape.

7. The package as set forth in claim 1, wherein the outer edges of said C-shaped clamps have reversely curved portions.

8. The package as set forth in claim 1, wherein said posts and clamps are formed as integral units and are affixed to said back plate.

9. The package as set forth in claim 1, wherein said back plate is provided with upper and lower extensions adapted to engage inner walls of the interior cavity of the carton to firmly register the slideable insert therein.

10. A package adapted to display contents thereof, said package comprising:

a carton having a rear wall and a front wall to define an interior cavity, said front wall having a transparent portion forming a window, a slideable insert adapted to fit into said cavity and register with the inside thereof, said insert having a back plate, said back plate having a plurality of projections affixed thereon, said projections having securement clamps formed thereon adapted to engage the contents of the package, locations and number of the projections being chosen according to the manner in which the contents are to be displayed, wherein said back plate is formed of a transparent plastic material.

11. A package adapted to display contents thereof, said package comprising:

a carton having a rear wall and a front wall to define an interior cavity, said front wall having a transparent portion forming a window, a slideable insert adapted to fit into said cavity and register with the inside thereof, said insert having a back plate, said back plate having a plurality of projections affixed thereon, said projections having securement clamps formed thereon adapted to engage the contents of the package, locations and number of the projections being chosen according to the manner in which the contents are to be displayed, wherein said back plate and said projections are formed of a transparent plastic material.

12. A package adapted to display contents thereof, said package comprising:

a carton having a rear wall and a front wall to define an interior cavity, said front wall having a transparent portion forming a window, a slideable insert adapted to fit into said cavity and register with the inside thereof, said insert having a back plate, said back plate having a plurality of projections affixed thereon, said projections having securement clamps formed thereon adapted to engage the contents of the package, locations and number of the projections being chosen according to the manner in which the contents are to be displayed, wherein said insert having said back plate, said projections and said clamps are formed as an integral unit, wherein said back plate and said projections are formed of a transparent plastic material.

13. A package adapted to display a figure having a main body and extremities, the package comprising:

a carton having a rear wall and a front wall to define an interior cavity, said front wall having a transparent portion forming a window;

a slideable insert adapted to fit into said interior cavity and register with said front and rear walls, said insert having a back plate, said back plate having a plurality of posts affixed thereto and extending outwardly therefrom toward said front wall, each of said posts having a securement clamp formed thereon adapted to engage the figure, wherein locations and number of said posts being chosen according to a manner in which the figure is to be displayed, wherein said posts support the figure at a position spaced away from said back plate.

14. A package according to claim 13 wherein said securement clamp comprises a snap clamp selected from the group consisting of: "C" clamp, and "U" clamp.

15. A package according to claim 13 wherein said plurality of posts comprises a first post adapted to engage the main body of figure, a second post adapted to engage one extremity of the figure, and a third post adapted to engage another extremity of the figure.

16. A package according to claim 13 wherein said posts are formed of a transparent plastic material.

17. A package according to claim 13 wherein said back plate and said posts are formed of a transparent plastic material.

18. A package according to claim 13 wherein said back plate and said posts are formed as an integral unit.

19. A package according to claim 13 wherein said back plate includes extensions at corners thereof for registering the back plate within said carton, wherein said extensions comprise a supporting structure such that said insert is removable from said carton and self supporting to display the figure in its original position out of the carton, and reinsertable back into the carton.

20. A package according to claim 13 wherein each of said posts provides rigid support of the figure in all directions.

21. A package adapted to display a toy or other article, said package comprising:

a carton having a rear wall and a front wall to define an interior cavity, said front wall having a transparent portion forming a window;

a slideable insert adapted to fit into said interior cavity and register with said front and rear walls, said insert having a back plate, said back plate having a plurality of posts affixed thereto and extending outwardly therefrom toward said front wall, each of said posts having a snap clamp formed thereon adapted to removably grasp the toy, wherein said back plate is formed angled away from said front wall, wherein said posts support the toy at a position spaced away from said back plate.

22. A package according to claim 21 wherein each of said posts provides rigid support of the figure in all directions.

23. A package according to claim 21 wherein the package is adapted to display a toy comprising a figure having a main body, arms and legs, wherein said plurality of posts comprises a first post adapted to engage the main body of figure, a second post adapted to engage one arm of the figure, and a third post adapted to engage one leg of the figure.

24. A package according to claim 21 wherein said back plate comprises two portions formed at right angles, angled away from said front wall.

25. A package according to claim 21 wherein said back plate comprises a curved section, angled away from said front wall.

26. A package according to claim 21 wherein said posts are formed of a transparent plastic material.

27. A package according to claim 21 wherein said back plate and said posts are formed of a transparent plastic material.

28. A package according to claim 21 wherein said back plate and said posts are formed as an integral unit.

* * * * *

UNITED STATES PATENT AND TRADEMARK OFFICE

CERTIFICATE OF CORRECTION

PATENT NO. : 6,575,302 B2
DATED : June 10, 2003
INVENTOR(S) : Spencer Hart Robley, Jr.

It is certified that error appears in the above-identified patent and that said Letters Patent is hereby corrected as shown below:

Column 5,
Line 47, delete the numeral "20"

Column 7,
Line 52, after "display stand when not inside the carton." insert new paragraph -- While the various figures show the backing plate and the attendant projections and clamps formed wherein the backing plate can be virtually of any configuration, there is also shown the backing plate, projections and clamps all formed as a single integral product. It is within the scope of the invention however that for manufacturing convenience, there may be a need to manufacture portions of the backing plate and/or the projections and clamps as separate products which may be assembled later. Thus, the invention --

Signed and Sealed this

Sixteenth Day of September, 2003

JAMES E. ROGAN
*Director of the United States Patent and Trademark Office*